United States Patent [19]

Meggs

[11] Patent Number: 4,579,344

[45] Date of Patent: Apr. 1, 1986

[54] IMPACT ABSORPTION PADS FOR GOALS

[76] Inventor: Dennis Meggs, R.R. #1, Ayr, Ontario, Canada, N0B 1E0

[21] Appl. No.: 669,955

[22] Filed: Nov. 9, 1984

[30] Foreign Application Priority Data

Nov. 9, 1983 [GB] United Kingdom ..... 8329858

[51] Int. Cl.[4] ..... A63B 71/00

[52] U.S. Cl. ..... 273/127 B; 273/411; 114/219

[58] Field of Search ..... 273/127 R, 127 B, 55 D, 273/411, 55 R, 400; 229/91; 217/53; 206/521; 128/38, 118; 272/109; 114/219

[56] References Cited

U.S. PATENT DOCUMENTS

| | | | |
|---|---|---|---|
| 2,956,530 | 10/1960 | Hobbs | 114/219 |
| 3,366,380 | 1/1968 | Montour | 272/119 |
| 3,406,968 | 10/1968 | Mason | 272/119 |
| 3,427,020 | 2/1969 | Montour et al. | 272/119 |
| 3,778,851 | 12/1973 | Howorth | 272/109 |
| 3,782,768 | 1/1974 | Moore | 114/219 |
| 3,924,851 | 12/1975 | Winston | 272/119 |

*Primary Examiner*—Richard C. Pinkham
*Assistant Examiner*—T. Brown
*Attorney, Agent, or Firm*—Sim & McBurney

[57] ABSTRACT

An impact-absorption pad for hockey goals or the like includes a tough, flexible sheath defining an elongated inner compartment substantially filled with a quantity of dry particulate material capable of shifting upon impact against the sheath to frictionally and inertially absorb at least part of the energy of impact. The sheath has at least one longitudinal flange with grommets or the like by which it can be secured to a post or bar.

13 Claims, 4 Drawing Figures

IMPACT ABSORPTION PADS FOR GOALS

This invention relates generally to the game of ice hockey, and has to do particularly with an accessory for hockey goals, designed to minimize the risk that the puck will rebound out of the hockey goal, and also to minimize the risk of injury to players.

BACKGROUND OF THIS INVENTION

In recent years, the game of hockey has seen many serious injuries to players, as a result of colliding with and being cut by certain portions of the hockey goal. One of the most serious risks has been in relation to the deflector plate that has typically been applied to the base bar curving around the back of the hockey goal structure, the intention of the deflector plate being to deflect the puck upwardly into the net, to avoid a quick rebound which might not be clearly seen by the judges. However, the deflector plate has in many instances become extremely sharpened, due to being dragged over concrete or wood when the hockey goal is being moved, and in the case where the goal is tilted up into the air, the leading sharpened edge of this deflector plate can become a lethal weapon for the injury of players sliding on the ice.

GENERAL DESCRIPTION OF THIS INVENTION

In view of the foregoing problems with the conventional state of the art, it is an aim of one aspect of this invention to provide an impact-absorption pad for a hockey goal to replace the deflector plate, thus providing for a safer goal construction while still allowing the advantage of showing the puck so that it can be clearly observed by the judges.

It is an aim of a further aspect of this invention to provide a combination of a hockey goal with padding structure, which avoids the dangers described earlier.

Accordingly, this invention provides an impact-absorption pad for a hockey goal or the like, comprising:

a tough, flexible sheath defining an elongated inner compartment and having at least one longitudinal flange securely attached thereto, the flange having means by which it can be secured to a post or the like, and in said inner compartment a quantity of dry particulate material capable of shifting upon impact against the sheath, thereby to frictionally and initially absorb at least part of the energy of impact, the particulate material being constituted by solid, hard plastic pellets.

Further, this invention provides a hockey goal which includes:

a net, a C-curved base bar for lying on the ice, and superstructure bars defining and supporting the goal opening and providing support for the net, and an impact-absorption pad lying along the base bar and protecting it from contact with a skate or the puck, the pad comprising:

a tough, flexible sheath defining an elongated inner compartment and having at least one longitudinal flange securely attached thereto, the flange having means by which it can be secured to a post or the like, and in said inner compartment a quantity of dry particulate material capable of shifting upon impact against the sheath, thereby to frictionally and inertially absorb at least part of the energy of impact.

GENERAL DESCRIPTION OF THE DRAWINGS

Two embodiments of this invention are illustrated in the accompanying drawings, in which like numerals denote like parts throughout the several views, and in which.

DETAILED DESCRIPTION OF THE DRAWINGS

Figure 1:
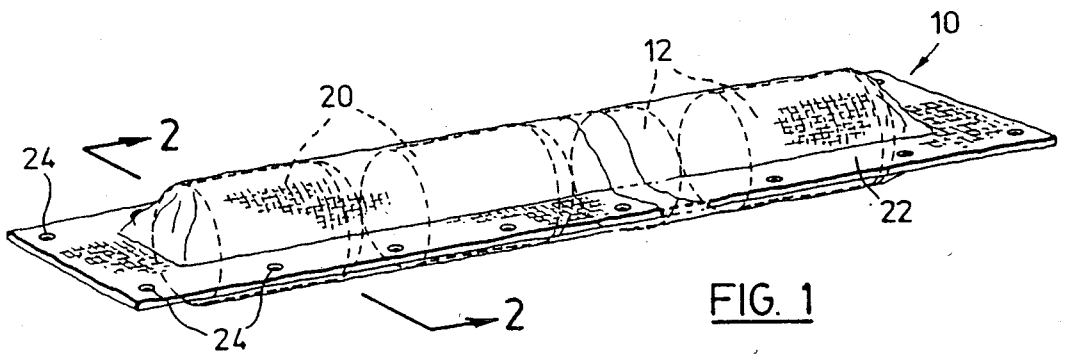
FIG. 1 is a perspective view of the first embodiment of this invention.
Figure 2:
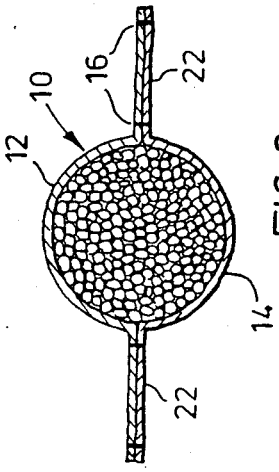
FIG. 2 is a sectional view taken at the line 2—2 of FIG. 1.

With reference to FIGS. 1 and 2, an impact absorption pad 10 includes an upper piece 12 and a lower piece 14, both being of tough fabric material. One suitable material for the pieces 12 and 14 is what is called ballistic nylon, preferably with a low friction coating. The nylon may have a weight from 15 ounces to 32 ounces, depending upon strength requirements. It has been found to be of advantage, where one of the pieces is intended to contact the ice, to coat and impregnate the material with urethane, for example with three coatings, so as to reduce or eliminate the risk of sticking to the ice.

Each of the pieces 12 and 14 is in the shape of an elongated rectangle, and the two pieces are sewn together along stitch lines as seen in FIG. 2 at the numeral 16, in order to provide a tough, flexible sheath defining an elongated inner compartment. It is understood that stitching would also be provided at either end of the elongated item.

The inner compartment between the two pieces 12 and 14 is filled with a particulate, impact-absorption material, such as recycled, dry, hard plastic pellets, and this material may be provided either in bulk and simply filled into the compartment between the two pieces 12 and 14, or alternatively it may be provided in individual packed bags made of PVC plastic or the like, so that, should the outer fabric or skin of the item become ruptured for any reason, the internal damage would extend only to one of the bags. This would mean that the contents of only that particular bag would risk leaking out of the impact-absorption pad. In FIG. 1, the individual plastic bags are identified by the numeral 20. It is emphasized, however, that tests have shown that the impact-absorption material may be placed loosely in bulk into the central compartment, and that it functions quite satisfactorily in that configuration.

At the marginal edges of the pieces 12 and 14, where the same are stitched together, side flanges 22 are defined. The flanges 22 are provided with grommets 24, which may be regularly spaced every six inches or so.

Figure 3:
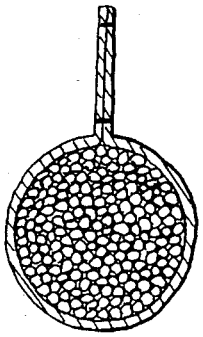
FIG. 3 is a view similar to FIG. 2, but of the second embodiment of the invention.

It has been explained previously in this disclosure that conventional practice has supplied a deflection plate for the lower C-shaped or double C-shaped base bar at the rear of a typical hockey goal used in North America. It is contemplated by this invention to replace the double C-shaped bar with a single C-shaped bar, i.e. without any forwardly projecting point, and to eliminate the deflector plate altogether. This would be replaced with a relatively long impact-absorbing pad of the kind described herein and shown in FIG. 3, which is the second embodiment of this invention. In this embodiment, only a single piece of the ballistic nylon or equivalent material, such as KEVLAR (trade mark) would be utilized, and the material may be simply folded over on itself and stitched along registering marginal portions. Again, grommets would be provided as in the first embodiment, and the bags of recycled plastics or the like may be provided within the cavity defined by the outer skin. Alternatively, the pellets could be provided in bulk, without being separately bagged.

Typical dimensions for such an impact-absorption pad would include an overall length of about ten feet, with the internal cavity, when filled, having a diameter of approximately three inches. The marginal flange 22 may have a width of approximately two inches. Such a pad could be affixed to the lower, C-shaped bar at the rear of a typical hockey goal by lacing or twine passed through the grommets 24 to secure the pad in place.

Similar though shorter pads, preferably in the form of the embodiment of FIG. 2, may be used for the forward-leaning central upright post of a hockey goal, and for covering other parts of the superstructure of the goal which it is desired to shield from impact with a player or puck.

Figure 4:
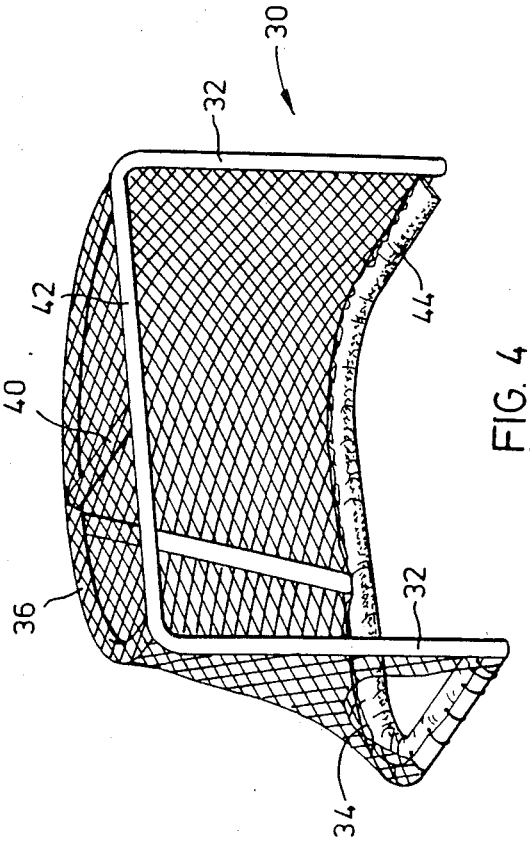
FIG. 4 is a perspective view of a hockey goal to which the pad of this invention has been applied.

In FIG. 4, a hockey goal shown generally at 30 has two upright posts 32, a C-shaped rear lower bar 34, an upper C-shaped bar 36, a forward sloping central post which in FIG. 4 is covered by a pad 38, and an upper central bar in the position 40 extending rearwardly from the middle of the top horizontal bar 42 forming with the posts 32 the basic goal opening. It can be seen in FIG. 4 that a pad 44 as defined in this disclosure is affixed around the inside of the C-shaped bar 34.

While two embodiments of this invention have been illustrated in the accompanying drawings and described in the foregoing disclosure, it will be apparent to those skilled in the art that changes and modifications may be made thereto without departing from the essence of the invention, as set forth in the appended claims.

What I claim is:

1. An impact-absorption pad for a hockey goal or the like, comprising:

a tough, flexible sheath defining an elongated inner compartment and having at least one longitudinal flange securely attached thereto, the flange having means by which it can be secured to a post or the like, and in said inner compartment a quantity of dry particulate material capable of shifting upon impact against the sheath, thereby to frictionally and inertially absorb at least part of the energy of impact, the particulate material being constituted by solid, hard plastic pellets.

2. The invention claimed in claim 1, in which the sheath has two longitudinal flanges, each as defined.

3. The invention claimed in claim 1, in which the said means is a plurality of grommets in the flange.

4. The invention claimed in claim 3, in which the sheath has two longitudinal flanges, each as defined.

5. The invention claimed in claim 1, in which the sheath is constructed of ballistic nylon woven material.

6. The invention claimed in claim 5, in which the pad is for use against the ice surface, and in which the nylon woven material contacting the ice is impregnated with urethane to reduce sticking to the ice.

7. A hockey goal which includes:

a net, a C-curved base bar for lying on the ice, and superstructure bars defining and supporting the goal opening and providing support for the net, and an impact-absorption pad lying along the base bar and protecting it from contact with a skate or the puck, the pad comprising:

a tough, flexible sheath defining an elongated inner compartment and having at least one longitudinal flange securely attached thereto, the flange having means by which it can be secured to a post, and in said inner compartment a quantity of dry particulate material capable of shifting upon impact against the sheath, thereby to frictionally and inertially absorb at least part of the energy of impact.

8. The invention claimed in claim 7, in which the particulate material is constituted by solid, hard plastic pellets.

9. The invention claimed in claim 7, in which the said means is a plurality of grommets in the flange.

10. The invention claimed in claim 7, in which the sheath is constructed of ballistic nylon woven material.

11. The invention claimed in claim 10, in which the portion of the nylon woven material of the sheath which contacts the ice is impregnated with urethane to reduce sticking to the ice.

12. The invention claimed in claim 7, further including additional sheaths as defined, the sheaths lying against at least some of the superstructure bars, said additional sheaths each having two longitudinal flanges, each as defined.

13. An impact-absorption pad for a hockey goal, the pad being for use against an ice surface, the pad comprising:

a tough, flexible sheath defining an elongated inner compartment and having at least one longitudinal flange securely attached thereto, the flange having means by which it can be secured to a post or the like, and in said inner compartment a quantity of dry particulate material capable of shifting upon impact against the sheath, thereby to frictionally and inertially absorb at least part of the energy of impact, the sheath being constructed of ballistic nylon woven material, the nylon woven material which contacts the ice being impregnated with urethane to reduce sticking to the ice.

* * * * *